US005804060A

United States Patent [19]

Benguigui et al.

[11] Patent Number: 5,804,060

[45] Date of Patent: Sep. 8, 1998

[54] METHOD OF AND APPARATUS FOR PRODUCING POWER IN SOLVENT DEASPHALTING UNITS

[75] Inventors: Ilan Benguigui, Tel Aviv, Israel; Richard L. Hood, Edmond, Okla.; Philip B. Rettger, Walnut Creek, Calif.

[73] Assignee: Ormat Process Technologies, Inc., Sparks, Nev.

[21] Appl. No.: 572,185

[22] Filed: Dec. 13, 1995

[51] Int. Cl.[6] ..... C10C 3/00; B01D 11/00

[52] U.S. Cl. ..... 208/309; 208/309; 208/311; 208/321; 208/45; 196/14.52

[58] Field of Search ..... 208/309, 311, 208/321, 45; 196/14.52, 134

[56] References Cited

U.S. PATENT DOCUMENTS

| | | | |
|---|---|---|---|
| 2,115,003 | 4/1938 | Beiswenger | 208/34 |
| 2,527,404 | 10/1950 | De Vault | 208/45 |
| 2,616,912 | 11/1952 | Dickinson | 208/309 |
| 2,850,431 | 9/1958 | Smith | 208/309 |
| 2,940,920 | 6/1960 | Garwin | 204/45 |
| 4,017,383 | 4/1977 | Beavon | 208/309 |
| 4,421,639 | 12/1983 | Lambert et al. | 208/309 |
| 4,784,753 | 11/1988 | Hotier et al. | 208/309 |

OTHER PUBLICATIONS

Avilino Sequeira, Lubricant Base Oil and Wax Processing, 1994, pp. 69–70, and title page of book, Marcel Dekker, Inc, New York, U.S.A. (no month).

*Primary Examiner*—Walter D. Griffin
*Attorney, Agent, or Firm*—Donald M. Sandler

[57] ABSTRACT

Power is generated in an organic Rankine cycle turbine by expanding a stream of solvent vapor produced by a flash drum in a deasphalting unit to produce a stream of expanded solvent vapor that is combined with a stream of solvent vapor and steam from a stripper of the deasphalting unit. Heat is extracted from the combined stream by an organic fluid that is vaporized and supplied to a Rankine cycle organic vapor turbine that produces power and expanded organic vapor. The solvent is recovered from the cooled, combined stream and re-used in the deasphalting unit. Heat extracted from products of the deasphalting unit vaporizes an organic fluid that is expanded in an organic vapor turbine that generates power.

27 Claims, 6 Drawing Sheets

METHOD OF AND APPARATUS FOR PRODUCING POWER IN SOLVENT DEASPHALTING UNITS

TECHNICAL FIELD

This invention relates to a method of and apparatus for producing power in fractionating units, and more particularly, in a solvent recovery section of a solvent deasphalting unit.

BACKGROUND OF THE INVENTION

A typical petroleum refinery receives crude oil and primarily produces gasoline, jet fuel, diesel fuel, and heating oil. The by-products of the refinery process are light gases, and heavy, viscous residual oil sometimes referred to as vacuum residual. The light gases can be used in the refinery, or sold outside the refinery as fuel.

To store, transport, and thus dispose of the heavy residual oil, it is conventional to reduce its viscosity by mixing with lower viscosity diluent such as diesel fuel produced by the refinery. The resultant residual fuel oil is usually sold as fuel to electric utilities.

Disposing of residual oil by blending with valuable diesel fuel is not always cost effective; and in many refineries, solvent deasphalting processing of the residual oil is carried out to produce charge stock for catalytic cracking, or hydrocracking units, and thus to reduce the amount of less valuable by-products. Such processing involves mixing the residual oil with a light hydrocarbon solvent, such as propane, iso-butane, normal-butane, iso-pentane, normal-pentane, or mixtures of these hydrocarbons. When a light hydrocarbon solvent is mixed with the residual oil under conditions of high pressure and temperature in an equilibrium vessel, the residual oil separates into two distinct fractions: a deasphalted oil (DAO) fraction essentially free of asphaltenes, and an asphaltene fraction containing a small portion of deasphalted oil which is soluble in this fraction. By providing additional equilibrium vessels, intermediate products can be produced which are not as "clean" as the DAO, but which are "cleaner" than the asphaltenes.

Immediately after separation, all fractions contain an appreciable amount of solvent. U.S. Pat. No. 2,940,920 discloses a solvent recovery system for a pentane solvent deasphalting unit wherein the output of the asphaltene separator contains about 0.6 volumes of solvent per volume of asphaltene. For a ratio of solvent to residual oil from the refinery of 4:1 to only 10:1 and a deasphalted oil yield of 40 to 80% volume, the volume of solvent to deasphalted oil ratio ranges from a low of 4.85:1 to a high of 24.1:1.

Once the solvent has been removed from the fractions, the solvent is available for re-use in deasphalting additional residual oil, and the resultant substantially solvent-free product can be stored or further utilized. The DAO can be recycled back to the refinery for conversion to gasoline, jet fuel, diesel fuel, and heating oil. The asphaltene fraction can be blended with a lighter, lower viscosity diluent such as diesel fuel, and converted to residual fuel oil for sale to utilities. In most cases, less diluent is required for blending the asphaltene fraction into residual fuel than is required to blend the residual oil into residual fuel. In some cases, the asphaltene fraction is blended with a lighter, lower viscosity diluent, such as the residual oil, and used as asphalt paving material.

Since the 1930's, solvent recovery systems for use with solvent deasphalting units were based on evaporative techniques such as that shown in FIG. 4.13 of *Lubricating Base Oil and Wax Processing* by A. Sequeira, published by Marcel Decker, New York, 1994. In such units, hot residual oil from a refinery, for example, and propane that has been heated and pressurized, are fed to a treating tower from the bottom of which issues a liquid stream of asphaltene and solvent whose rate is controlled by the setting of a flow control valve, and from the top of which issues a liquid stream of DAO and solvent at almost the temperature and pressure of the tower. Each of these streams is conveyed to separate flash drums where the solvent flashes to a vapor that is cooled and sent to a solvent drum for storage, the pressure of the vaporized solvent from the high pressure DAO flash drum being at a much higher pressure than that of the vaporized solvent from the low pressure flash drums and the solvent drum.

In order to reduce the amount of solvent that has to be evaporated, a supercritical solvent recovery process may be carried out on the lighter fraction from the asphaltene separator before the evaporative process described above is effected. U.S. Pat. No. 2,115,003 discloses such a supercritical solvent recovery process. Solvent is recovered by bringing the solvent and deasphalted oil mixture to just below or just above the critical temperature and pressure in order to achieve a phase separation for solvents such as ethane, propane, butane, pentane and mixtures of these. The patent includes a schematic showing feed/effluent exchange from the deasphalted oil separator, and thus provides a basic, simplified process schematic for supercritical solvent recovery.

U.S. Pat. No. 2,527,404 discloses the supercritical solvent recovery of propane at 205° to 225° F. and a pressure of 580 to 650 psig. The critical properties of propane are 206.01° F. and 601.6 psig. This patent further discloses that the recovered propane will have only about 0.5% volume DAO, and the DAO will have only about 0.2 to 0.6 volumes of propane per volume of oil.

For solvents heavier than propane, U.S. Pat. No. 2,940,920 discloses that solvent ratios of 4:1 to as high as 20:1 are economically viable when the solvent is recovered by phasing out of solution when the density is decreased to less than 0.23. This patent further discloses that pentane is recovered at 420° F. and 525 psig, the critical properties of pentane being 386.6° F. and 473.9 psig. From these observations, it would appear that the amount of solvent that has to be vaporized for recovery is substantially reduced by using supercritical solvent recovery as a preliminary solvent recovery step.

Because the cost of heat for evaporative solvent recovery is high, solvent ratios are minimized when supercritical solvent recovery is not used as the primary solvent recovery technique. U.S. Pat. Nos. 2,527,404 and 2,940,920 indicate that only 0.6 volumes of solvent per volume of product is not recovered by supercritical means. The solvent that is not recovered by supercritical means is recovered by evaporation at a much higher heat requirement.

The concept of multi-stage solvent recovery is well known in the industry. In multi-stage solvent recovery, the solvent is recovered at increasingly higher temperatures and decreasingly lower pressures in stages. The high temperature vapor from one stage is exchanged with the incoming liquid to a previous stage in order to effect the vaporization of the incoming solvent. With several stages, up to one barrel of solvent can be vaporized for every barrel of solvent that is condensed. However, in multi-stage solvent recovery, the lowest temperature that can be achieved without external heat release is near the temperature of the asphaltene separator. Therefore, a significant amount of heat has to be released to the atmosphere to recover the solvent.

Even with the use of supercritical solvent recovery or multi-stage solvent recovery, a significant amount of heat must be added to the process to recover solvent by evaporation, and much of this heat is released to the environment.

It is therefore an object of the present invention to provide a new and improved method of and means for producing power in solvent deasphalting units which substantially overcomes or significantly reduces the disadvantages outlined above for evaporative solvent recovery in solvent deasphalting units, regardless of whether supercritical solvent recovery is employed as the primary solvent recovery technique.

BRIEF DESCRIPTION OF THE INVENTION

In accordance with present invention, a method for producing power in a solvent deasphalting unit is provided comprising expanding solvent vapor extracted from the overhead solvent vapor stream exiting one or more flash drums in an organic Rankine cycle turbine for producing electrical or mechanical power and from which expanded solvent vapor is extracted. The expanded vapors extracted from the turbine can be added to solvent vapors coming from the overhead solvent vapor stream of lower pressure flash drums and product strippers to produce a combined solvent vapor stream from which heat is extracted by exchanging heat with an organic fluid in a heat exchanger for cooling and condensing said combined solvent stream and vaporizing the organic fluid. The vaporized organic fluid is then expanded in a further organic Rankine cycle turbine for producing electrical or mechanical power with the expanded organic vapor being extracted from the turbine while the cooled combined solvent vapor stream is subsequently supplied to a solvent drum. Subsequently, the expanded organic vapor is then cooled and condensed and organic fluid condensate is produced which is pressurized and supplied back to the heat exchanger for extracting heat from the combined solvent stream once again. In addition, the cooled combined solvent stream can be further cooled using ambient air or water in a heat exchanger.

In a further aspect of the present invention, a method for extracting heat from deasphalted oil product exiting a deasphalted oil stripper, or even from product streams in which the deasphalted oil is one of the blend components, is also provided by exchanging heat with an organic fluid in a further heat exchanger for cooling the deasphalted oil product and vaporizing the organic fluid. The vaporized organic fluid is expanded in a still further organic Rankine cycle turbine for producing electrical or mechanical power and from which expanded organic vapor is extracted. The expanded organic vapor is cooled and condensed producing organic fluid condensate which is pressurized and supplied to the heat exchanger for extracting heat from the deasphalted oil product once again.

In a still further aspect of the present invention, a method for extracting heat from asphaltene product exiting an asphaltene stripper or even from product streams in which the asphaltene product is one of the blend components, is provided by exchanging heat with an organic fluid in an still additional heat exchanger for cooling said asphaltene product or product blend and vaporizing the organic fluid. The vaporized organic fluid is expanded in an additional organic Rankine cycle turbine for producing electrical or mechanical power and from which expanded organic vapor is extracted. Thereafter, the expanded organic vapor is cooled and condensed producing organic fluid condensate which is pressurized and supplied back to the additional heat exchanger for extracting heat from the asphaltene product.

Moreover, the present invention comprises apparatus for carrying the above mentioned method steps of the present invention.

BRIEF DESCRIPTION OF THE DRAWINGS

Embodiments of the present invention are described by way of the example with reference to the accompanying drawings wherein.

DETAILED DESCRIPTION

Figure 1A:
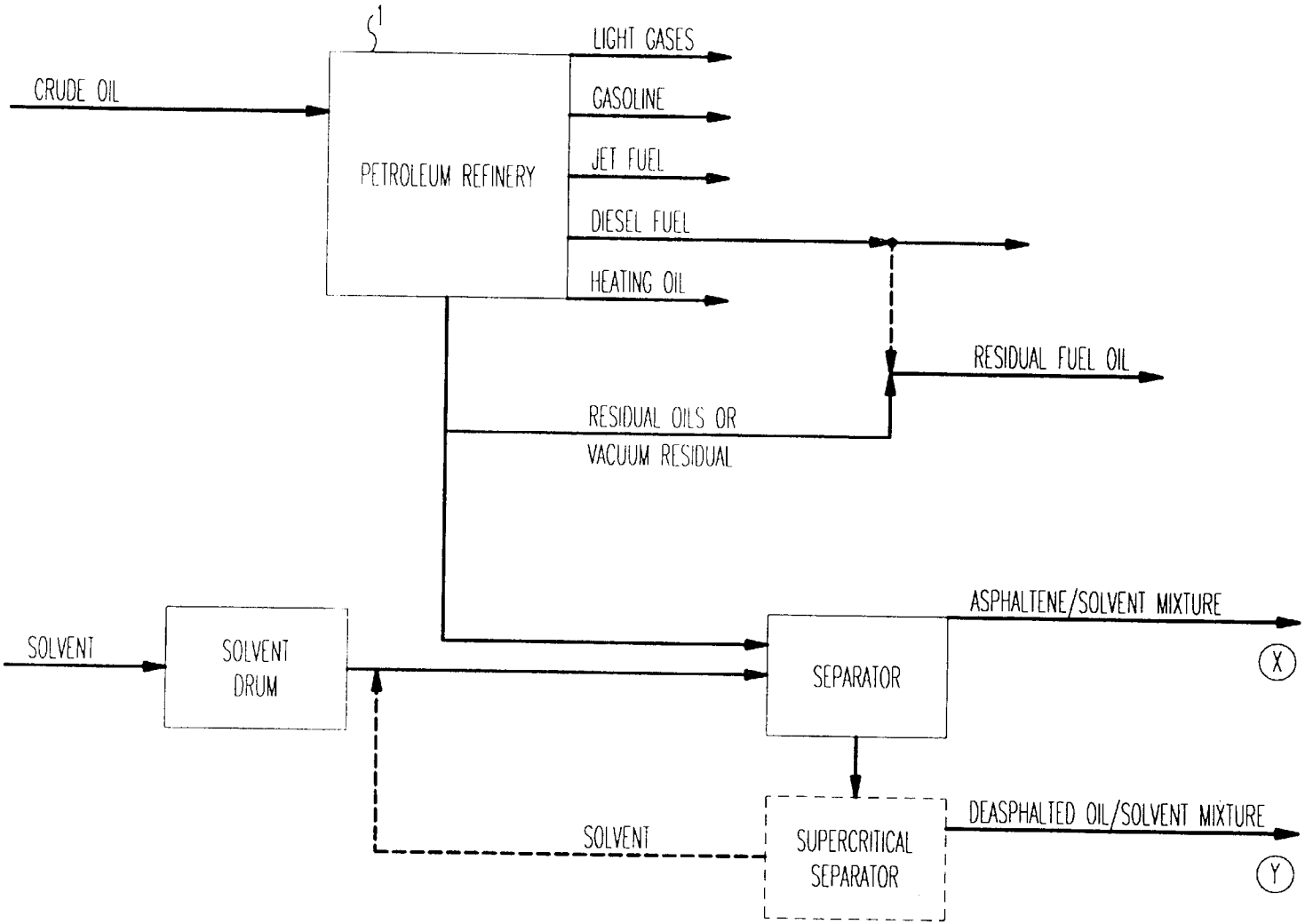
FIG. 1A (PRIOR ART)
FIG. 1A is a block diagram of a typical oil refinery designed to produce, from the residual oil, an asphaltene/solvent stream and a deasphalted oil/solvent stream.

Referring now to FIG. 1A, reference numeral 1 designates a typical petroleum refinery that receives crude oil and primarily produces gasoline, jet fuel, diesel fuel, and heating oil. Light gases, which are a by-product of the refinery process are typically sold, or used inside the refinery as fuel. Heavy, viscous residual oil, sometimes referred to as vacuum residual, are also by-products, and are typically converted to residual fuel and sold to electric utilities by blending with diesel fuel to reduce viscosity. This blending process is indicated by the broken lines connecting the diesel fuel output of the refinery to the residual oil output.

An alternative way to dispose of the residual oil is to utilize a solvent deasphalting unit which involves mixing the residual oil with a light hydrocarbon solvent in a separator to form a mixture that separates into a product stream of asphaltene/solvent, and a product stream of deasphalted oil/solvent. The solvent deasphalting unit includes a solvent recovery section which is effective to remove substantially all of the solvent from the product streams, thus recovering the solvent which is returned to the deasphalting unit.

The solvent recovery unit may utilize a supercritical solvent recovery process to remove a great deal of solvent from the DAO product stream; the balance of the solvent being removed by an evaporative solvent recovery process operating on the heavy and any intermediate product streams and the DAO product stream produced by the supercritical solvent recovery process. If supercritical solvent recovery is not used as the primary means to recover solvent from the DAO, an evaporative solvent recovery process would operate on all of the product streams. It is the evaporative solvent recovery process with which the present invention is concerned.

An evaporative solvent recovery process, which operates on the streams produced as described above, is shown by reference numeral 10 in FIG. 1B, and is applicable to solvent recovery systems using supercritical and subcritical solvent recovery, or only subcritical solvent recovery. Such process recovers the solvent so that it can be used again, and produces a product stream of asphaltene, and a product stream of DAO. The DAO fraction is recycled back to the refinery for conversion to gasoline, jet fuel, diesel fuel, and heating oil. The asphaltene fraction may be blended with a lighter, lower viscosity diluent such as diesel fuel, and converted to residual fuel oil for sale to utilities, or in some cases, sold as solid fuel.

The liquid asphaltene/solvent stream from the separator is directed via line 21 to asphaltene flash drum 26. In most solvent deasphalting units external heat is added to the product in line 21 by heater 22. Flow control valve 24 in line 23 that is connected to flash drum 26 is used to regulate the flow of asphaltene/solvent to drum 26.

Similarly, the liquid deasphalted oil/solvent stream from the separator is directed via line 61 to deasphalted oil flash drum 66. External heat may be added to the product in line 61 if necessary by heater 62; and flow control valve 64 is used to regulate the flow of deasphalted oil/solvent to drum 66.

At the pressures and temperatures in drums 26 and 66, solvent in each of the drums flashes to a vapor leaving a more concentrated mixture in the drums from which flow reduced solvent liquid product streams. Line 32 carries the overhead solvent vapor stream from drum 26 (i.e., the stream leaving the top of the drum) to junction "A" in line 33 upstream of pressure-reducing valve 38, and line 72 carries the overhead solvent vapor stream from drum 66 to junction "A".

Line 27 carries the more concentrated asphaltene/solvent mixture from the bottom of drum 26 to heater 28 where the mixture is heated and delivered to stripper 30 via line 29. Line 67 carries the more concentrated deasphalted oil/solvent mixture from the bottom of drum 66 to heater 28 where the mixture is heated and delivered to stripper 70 via line 69. Optionally, heaters 28 and 68 can be incorporated into the product strippers, and in some cases are not used.

Each stripper is supplied with steam and operates at a pressure that is slightly higher than the vapor pressure of the solvent at ambient temperature with the exception of solvent deasphalting units using a light solvent, such a propane, where a compressor is needed to raise the pressure of the stripper overhead solvent stream to the vapor pressure of the solvent at ambient temperature. In such units, the stripper operates at substantially atmospheric pressure. Operating the stripper at low pressure strips a maximum amount of the solvent remaining in the more concentrated mixture delivered to the stripper producing at the overhead of the stripper, a stream of steam and vaporized solvent, and at the bottom of the stripper, a stream of the desired product substantially free of solvent. The solvent in the stream of vaporized solvent and steam is recovered by directing the stream to a condenser which condenses the steam and solvent allowing the solvent to separate from the steam condensate, and to be collected in a drum for re-use. The condensate is removed from the drum and purged from the unit.

In the process of recovering the solvent, line 40 carries the stream of vaporized solvent and steam from the overhead of stripper 30 to junction "B" in line 41; and line 75 carries the stream of vaporized solvent and steam from the overhead of stripper 70 also to junction "B". Line 41 carries the combined streams of vaporized solvent and steam from the strippers to junction "C" where the vapors are combined with the combined stream of vaporized solvent flowing in line 39 downstream of pressure reducer 38. The pressure at junction "A" is substantially higher than the pressure at junction "C". The range for the pressure difference between junction "A" and junction "C" is 50 to approximately 450 psig., with a typical value of approximately 200 psig.

Line 42 carries the combined stream of vaporized solvent and steam to condenser 45 (shown as being air-cooled) where the steam and solvent are condensed to liquids and sent to a solvent drum where the condensed steam separates from the solvent. The liquid solvent is returned for re-use in the unit. The steam condensate, or sour water, is purged from the unit.

In the solvent recovery system described above, a considerable amount of heat must be added to the process to make it work; and much of this heat is rejected by the condenser to the atmosphere. The amount of heat rejected to the atmosphere varies from a low value of approximately 145 BTU per pound of solvent evaporated in a propane deasphalting unit, to approximately 265 BTU per pound of solvent evaporated in a solvent deasphalting unit using n-pentane solvent. The amount of heat rejected per pound of solvent increases with the operating temperature of the asphaltene/deasphalted oil separator.

According to the present invention, pressure reducer valve 38 is eliminated and replaced by an organic vapor turbine. When pentane solvent is used, an approximately ten-fold expansion takes place across the turbine which drives a generator and produces power. When propane solvent is used, the expansion is on the order of two to one. Optionally, further heat may be extracted from the solvent, and/or the products produced by the solvent recovery unit, and converted to electricity. One form of the invention is contained in apparatus 100 shown in FIG. 2A.

Figure 1B:
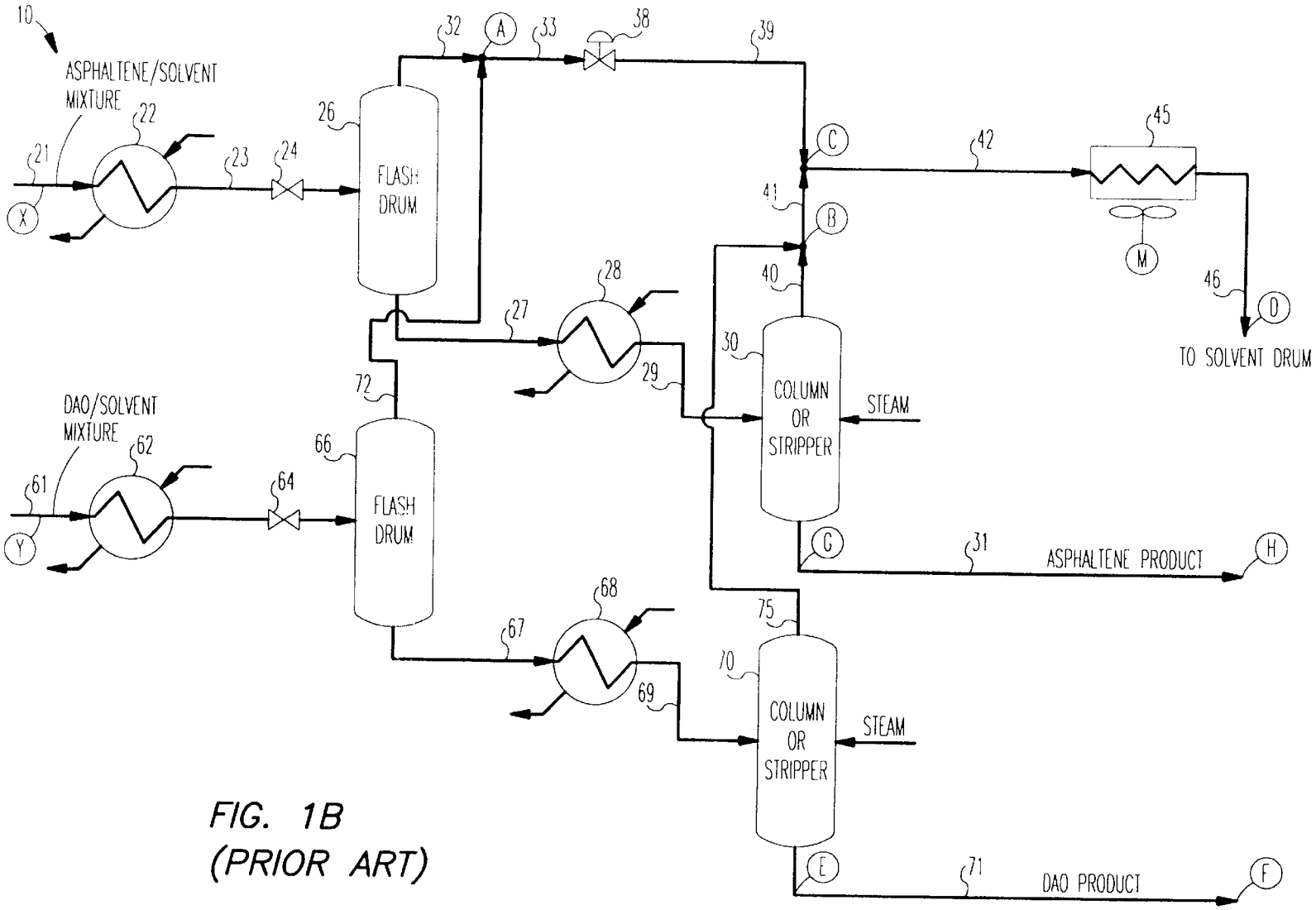
FIG. 1B (PRIOR ART)
FIG. 1B is a block diagram of an evaporative solvent recovery section of a solvent deasphalting unit which receives an asphaltene/solvent stream, and a deasphalted oil/solvent stream and recovers the solvent, and produces product in the form of asphaltene, and deasphalted oil.
Figure 2A:
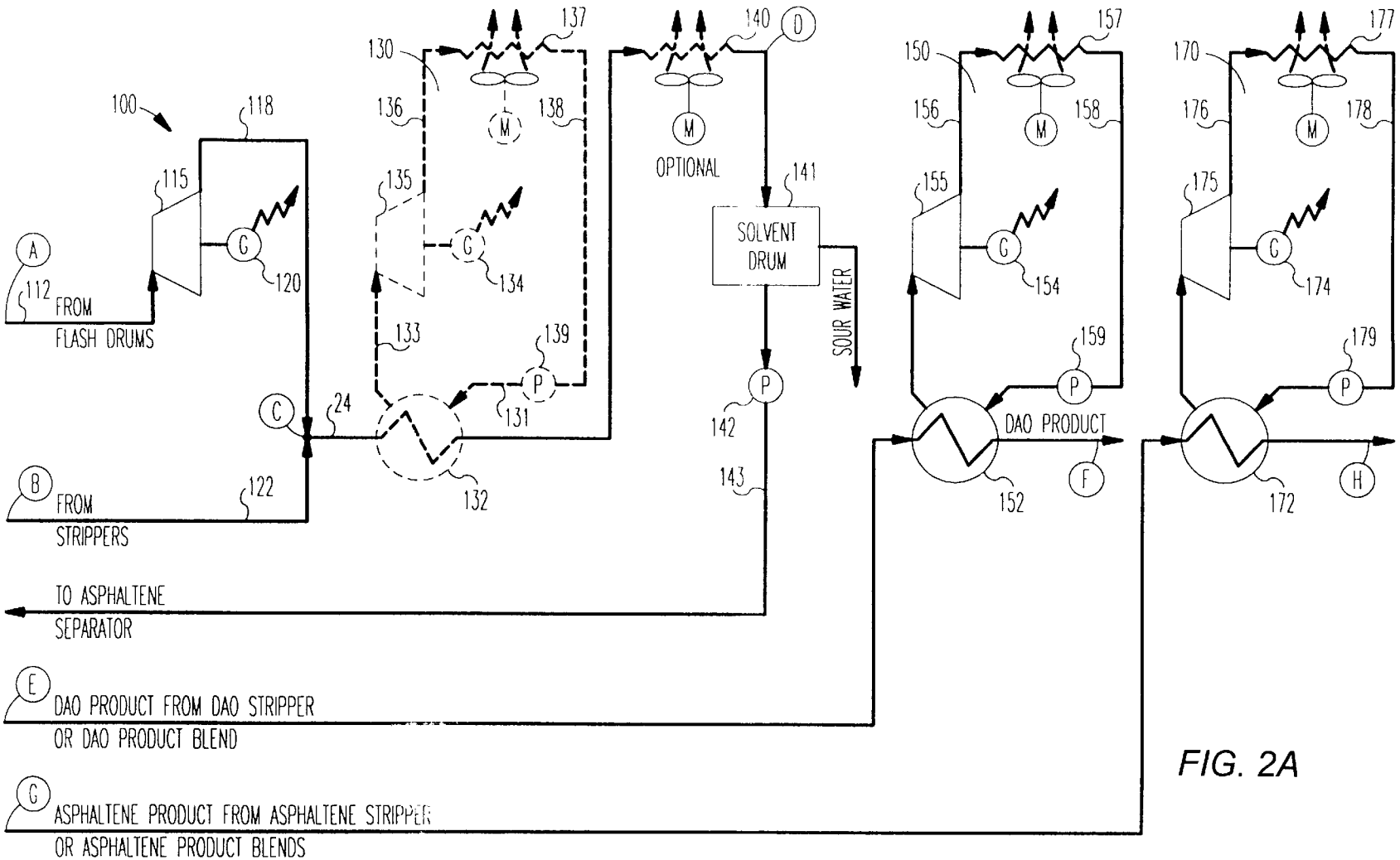
FIG. 2A is a block diagram of one embodiment of the present invention for incorporation into the unit shown in FIG. 1B.
Figure 2B:
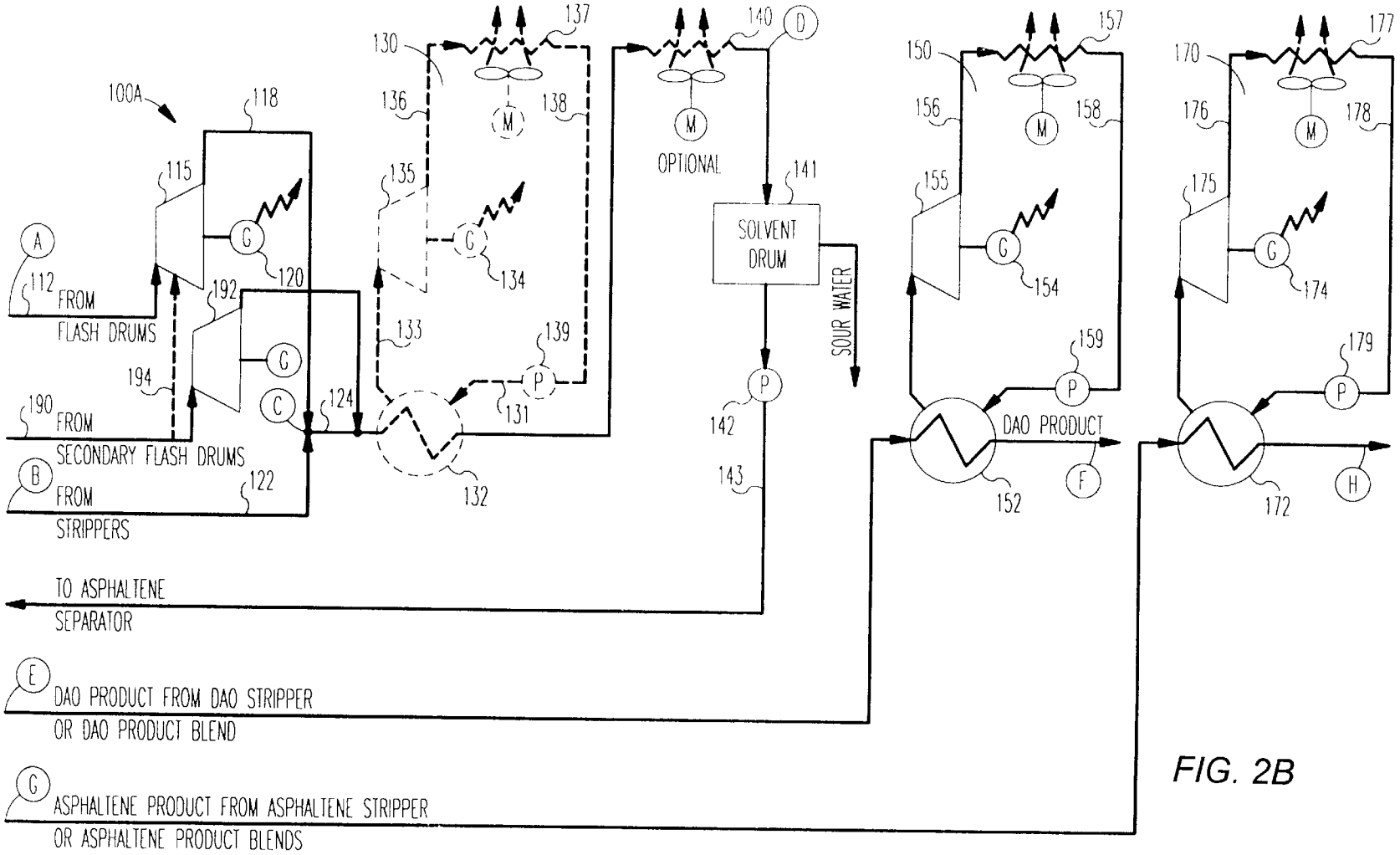
FIG. 2B is a block diagram of a modification of the embodiment shown in FIG. 2A.

Points "A" to "H" in FIG. 2A refer to similarly labeled points in FIG. 1B. For example, points "A" and "B" in FIG. 2 are connected to points "A" and "B" in FIG. 1B, and reducer valve 38 is eliminated. Thus, high pressure vaporized solvent from the overheads of flash drums 26 and 66 is applied via line 112 to organic vapor turbine 115 where expansion takes place driving generator 120 coupled to the turbine and producing electricity. Exhaust line 118 carries the expanded, lower pressure, vaporized solvent from the turbine to junction "C" which also receives steam and vaporized solvent from strippers 30 and 70. Line 124 carries the combined vapor stream to condenser 140, which is optional depending upon whether energy converter 130 is utilized.

Energy converter 130 includes heat exchanger 132 containing an organic fluid such as normal or iso-pentane, or other suitable organic fluid, which is vaporized as a result of cooling of the vaporized solvent flowing in line 124. Vaporized organic fluid produced by heat exchanger 132 flows via line 133 to organic vapor turbine 134 wherein expansion takes place driving generator 134 coupled to this turbine and producing expanded organic vapor that is condensed in condenser 137, which is preferably air cooled. The condensed organic fluid is transferred via line 138 to cycle pump 139 which delivers the condensate via line 131 to heat exchanger 132 to complete the cycle.

Depending on the organic fluid chosen for converter 130, heat exchanger 140 may or may not be required for further cooling and/or condensing the combined stream to recover the solvent.

A converter, like that shown by reference numeral 130 can be applied at other locations in the system anywhere an air cooler or water cooler is needed to cool or condense the solvent. In the case where the solvent is the same as the organic fluid of the converter, the external power loop can be commingled with the process solvent.

In addition, as shown in FIG. 2A, deasphalted oil (DAO) exiting deasphalted oil stripper 70 may be cooled using converter 150. In such case, organic fluid, such as n-pentane, iso-pentane or other suitable fluid, in heat exchanger 152 is vaporized as the DAO is cooled. The resultant vaporized organic fluid is applied to organic Rankine cycle turbine 155 where expansion takes place driving generator 154 coupled to the turbine and producing expanded organic vapor. The expanded organic vapor is then supplied to condenser 157, shown as being air-cooled, wherein condensation takes place. Line 158 carries the condensed organic vapor to cycle pump 159 which pressurizes the condensate and delivers it to heat exchanger 152.

Also as shown in FIG. 2A, asphaltene product exiting asphaltene stripper 30 may be cooled using converter 170. In such case, organic fluid, such as n-pentane, iso-pentane or other suitable fluid, in heat exchanger 172 is vaporized as the asphaltene product is cooled. The resultant vaporized organic fluid is applied to organic Rankine cycle turbine 175 where expansion takes place driving generator 174 coupled to the turbine and producing expanded organic vapor. The expanded organic vapor is then supplied to condenser 177, shown as being air-cooled, wherein condensation takes place. Line 178 carries the condensed organic vapor to cycle pump 179 which pressurizes the condensate and delivers it to heat exchanger 172.

The arrangement shown in FIG. 1B is based on single stage flashing of the stream of asphaltene/solvent and of the stream of deasphalted oil/solvent. Some solvent deasphalting units use multiple stage flashing so that a lower pressure vaporized solvent stream is produced by secondary flash drums upstream of the stripper. When this is the approach taken, the present invention may be configured as shown by apparatus 100A shown in FIG. 2B. In this apparatus, vaporized solvent from the primary flash drums is applied via line 112 to high pressure organic vapor turbine 115 which is coupled to generator 120. Vaporized solvent from the secondary flash drums is applied via line 190 to low pressure turbine 192 also coupled to a generator. Alternative to having two separate turbines and generators, a single, multi-staged organic vapor turbine may be used with the secondary flash output being applied to intermediate stages of the turbine.

Figure 3:
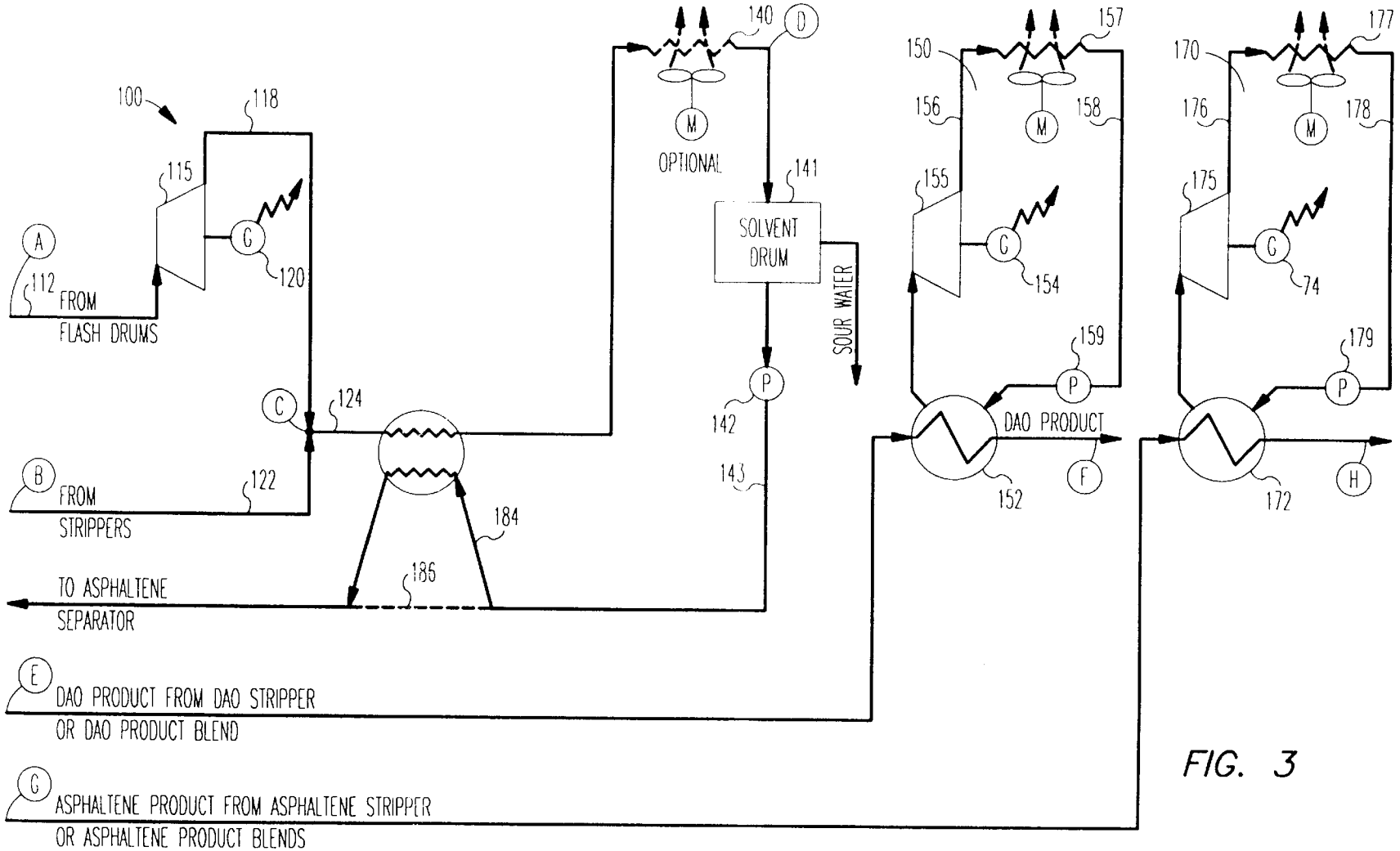
FIG. 3 is a block diagram of another embodiment of the present invention.

Alternative to using a converter like that shown in FIG. 2A at 130 to extract and use heat contained in the vaporized solvent derived from the flash drums, heat contained in the combined stream of vaporized solvent and steam in line 124 can be utilized to preheat solvent from solvent drum 141. This is shown in FIG. 3 wherein heat exchanger 180 is located between lines 124 and 143.

Figure 4:
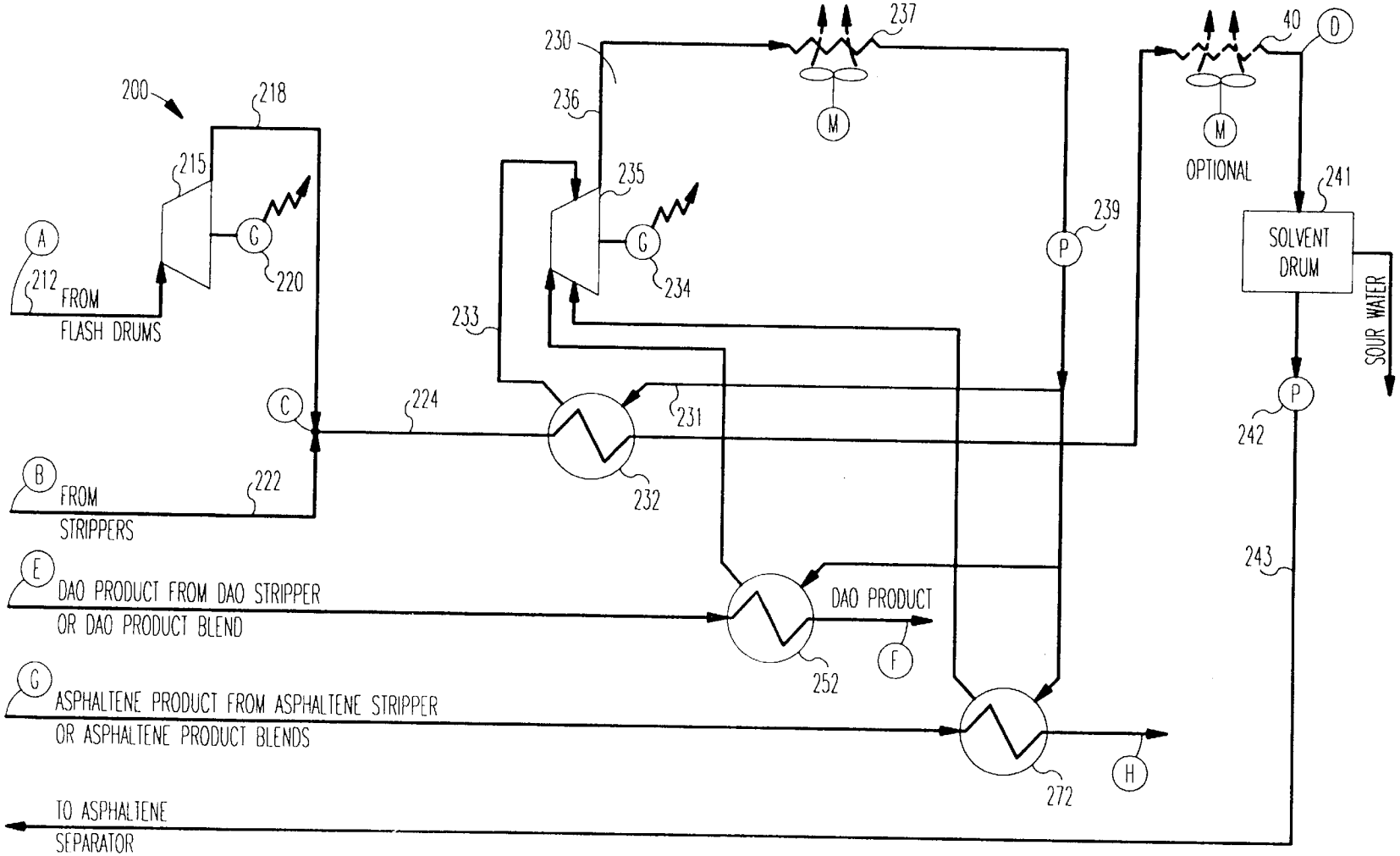
FIG. 4 is a block diagram of a further embodiment of the invention.

In a still further embodiment of the invention shown in FIG. 4, apparatus 200 utilizes heat in the stream of vaporized solvent and steam at junction "C" and heat in the product lines at junctions "E" and "G", to vaporize an organic fluid which is supplied to an energy converter. As shown, heat exchanger 232 receives the combined stream of vaporized solvent and steam at junction "C" and vaporizes an organic fluid much like converter 130 in FIG. 2B. The vaporized working fluid is applied to multi-stage organic vapor turbine 235. Heat exchanger 252 in the product line containing DAO produced by stripper 70, or a DAO product blend, vaporizes an organic fluid to a pressure higher than the pressure of the organic fluid vaporized in heat exchanger 232; and the higher pressure vaporized organic fluid is applied to the inlet of turbine 235.

Heat exchanger 272 in the product line containing asphaltene product produced by stripper 30, or an asphaltene product blend, vaporizes an organic fluid to a pressure lower than the pressure of the organic fluid vaporized in heat exchanger 252 but higher than the pressure produced in heat exchanger 232. This medium pressure, vaporized organic fluid is applied to an intermediate stage of turbine 235. Consequently, organic vapor produced by heat exchanger 232, in the example considered here, having a pressure lower than vapor exiting heat exchanger 272, is supplied to an even lower pressure intermediate stage of turbine 235. However, it is to be appreciated that FIG. 4 is only schematic; and in other cases, the levels of temperature of the heat sources and consequently the level of pressures of the organic vapors produced in heat exchangers 232, 252, and 272, respectively, may be different from those disclosed above with reference to FIG. 4. In such case, the level and order in which the vapors exiting these heat exchanger enter turbine 235 may be different from that shown in FIG. 4. In addition, in certain cases, the pressure levels of the organic vapor exiting the heat exchangers may be substantially the same so that a common inlet into a particular stage of the turbine may be used for vapors exiting these heat exchangers.

Also in this embodiment, depending on the organic fluid chosen for the organic power cycle, heat exchanger 140 may or may not be required for cooling the combined stream to achieve the desired conditions for stream 142.

While coolers 137,140, 157, 177, 237, and 240 in the drawings are shown as air-cooled, the coolers can be also cooled by water in accordance with the present invention.

Also, while the drawings show the turbines coupled to electric generators, the turbines may be directly coupled to pumps and other components of the system. Additionally, while the present invention discloses the use of heat available in the DAO product and/or the asphaltene product, the present invention also contemplates producing power without using these products merely from solvent vapor in the stream exiting the flash drums in a deasphalting unit. Furthermore, the present invention also contemplates producing power from any one of these products alone or even only some of them together.

In addition, it should be appreciated that the present invention is applicable to all solvent deasphalting units, regardless of whether part of the solvent is recovered by supercritical means, or whether two or more separate products are produced, or whether one or more flash vessels is used for recovery of the solvent from one or more product streams. It should also be appreciated that the present invention is appropriate for propane, iso-butane, n-butane, n-pentane, iso-pentane, and all other solvents and their combinations which are useful in deasphalting plants. Moreover, it should be understood that while the present specification refers to deasphalting units, the term commonly used in the art, this term is used in the specification to be equivalent to deasphaltening units as well.

The embodiments described above deal with a staged solvent recovery system in which a solvent bearing product stream is first subjected to a flashing process to produce a reduced solvent product stream that is then subjected to a stripping process to produce substantially solvent-free product. Under some production conditions, a solvent bearing product stream may be subjected to only a stripping process.

Regardless of the process by which a substantially solvent-free product is formed, such product will contain a substantial amount of heat that must be extracted before the product is stored or used. The present invention contemplates extracting heat from the product using an organic fluid Rankine cycle energy converter as shown at 150 and 170 in FIG. 2A, for example. In addition, the vaporized solvent produced by the stripping process can be applied to an energy converter like that designated by reference numeral 130 in FIG. 2A.

Furthermore, it should be pointed out that most of the solvents conventionally used in solvent deasphalting units also have desirable physical properties that make such solvents well suited for use as a working fluid in an organic fluid Rankine cycle power plant. This can be used to advantage in accordance with the present invention.

The advantages and improved results furnished by the method and apparatus of the present invention are apparent from the foregoing description of the preferred embodiment of the invention. Various changes and modifications may be made without departing from the spirit and scope of the invention as described in the appended claims.

We claim:

1. A method for producing power in a solvent recovery section of a solvent deasphalting unit that produces a plurality of liquid product streams comprising a liquid stream of deasphalted oil and solvent, and a liquid stream of asphaltene and solvent, said method comprising:

a) flashing at least one of said liquid product streams for producing a stream of vaporized solvent, and a reduced solvent liquid product stream;

b) expanding said stream of vaporized solvent in a solvent vapor turbine for producing power and a stream of expanded vaporized solvent; and c) cooling and condensing said stream of expanded vaporized solvent.

2. A method according to claim 1 wherein cooling and condensing said stream of expanded vaporized solvent includes:

a) transferring heat in said stream of expanded vaporized solvent to an organic fluid that is vaporized as a result for producing a stream of vaporized organic fluid;

b) expanding said vaporized organic fluid in an organic vapor turbine for producing power and expanded vaporized organic fluid; and c) condensing said expanded vaporized organic fluid to organic fluid condensate.

3. A method according to claim 1 including:

a) stripping solvent from a liquid product stream to produce a stripped vaporized solvent stream and a substantially solvent-free product stream; and b) combining said stripped vaporized solvent stream with said stream of expanded vaporized solvent before cooling and condensing the combined stream.

4. A method according to claim 3 including:

a) transferring heat in said substantially solvent-free product stream to a heat transfer fluid constituted by liquid organic fluid for producing a cooled product stream and vaporized organic fluid;

b) expanding said vaporized organic fluid in a turbine for producing power and expanded vaporized organic fluid;

c) condensing said expanded vaporized organic fluid for producing liquid organic fluid; and d) using said liquid organic fluid produced in step c) as the heat transfer fluid in step a).

5. A method according to claim 1 wherein said solvent is selected from the class consisting of normal pentane, iso-pentane, normal butane, iso-butane, propane, and mixtures thereof.

6. Apparatus for producing power in an evaporative solvent recovery section of a solvent deasphalting unit that produces a plurality of different liquid product streams, said apparatus comprising:

a) a flash drum for flashing at least one of said liquid product streams for producing a stream of vaporized solvent, and a reduced solvent liquid product stream;

b) a solvent vapor turbine for expanding said stream of vaporized solvent and producing power and a stream of expanded vaporized solvent; and c) cooler apparatus for cooling and condensing said stream of expanded vaporized solvent.

7. Apparatus according to claim 6 said cooler apparatus includes:

a) a heat exchanger containing an organic fluid for receiving said stream of expanded vaporized solvent and producing vaporized organic fluid;

b) an organic vapor turbine for expanding said vaporized organic fluid and producing power and expanded vaporized organic fluid;

c) a condenser for condensing said expanded vaporized organic fluid to organic fluid condensate; and d) means for returning said condensate to said heat exchanger.

8. Apparatus according to claim 6 including:

a) a stripper for stripping solvent from said reduced solvent liquid product stream to produce a stripped vaporized solvent stream and a substantially solvent-free product stream; and b) means for combining said stripped vaporized solvent stream with said stream of expanded vaporized solvent to form a combined stream that is applied to said cooler apparatus.

9. Apparatus according to claim 8 including:

a) a heat exchanger for transferring heat in said substantially solvent-free product stream to an organic fluid for producing a cooled product stream and vaporized organic fluid;

b) an organic vapor turbine for expanding said vaporized organic fluid and producing power and expanded vaporized organic fluid;

c) a condenser for condensing said expanded vaporized organic fluid and producing organic fluid condensate; and d) means for returning said condensate to said heat exchanger.

10. A solvent recovery section of a deasphalting unit including a solvent drum from which liquid solvent is applied to a separator that receives residual oil and that produces a plurality of liquid product streams that include a liquid stream of deasphalted oil (DAO) and solvent, and a liquid stream of asphaltene and solvent, said section comprising:

a) means for heating said liquid product streams;

b) a plurality of primary flash drums respectively associated with the heated liquid streams for producing respective streams of high pressure vaporized solvent, and respective streams of reduced solvent liquid product streams;

c) means for combining said streams of high pressure vaporized solvent into a combined stream of reduced pressure vapor;

d) a plurality of strippers respectively associated with the streams of reduced solvent liquid product for producing respective streams of low pressure vaporized solvent, and respective streams of substantially solvent-free product;

e) means for cooling said streams of substantially solvent-free product;

f) means for combining said combined stream with said streams of vaporized solvent from said strippers into a final stream;

g) means to cool said final stream for condensing said solvent; and h) means for returning condensed solvent to said solvent drum;

i) wherein said means for combining said streams of high pressure vaporized solvent into a combined stream of reduced pressure vapor includes a solvent vapor turbine for expanding said streams of high pressure vaporized solvent.

11. A solvent deasphalting unit according to claim 10 wherein said means to cool said final stream includes a heat exchanger containing an organic fluid that is vaporized as the final stream is cooled, an organic vapor turbine for expanding vaporized organic fluid produced by said heat exchanger and producing power and expanded vaporized organic fluid, and means for condensing said expanded vaporized organic fluid and producing condensate that is returned to said heat exchanger.

12. A solvent deasphalting unit according to claim 10 wherein said means for cooling said streams of substantially solvent-free product includes at least one heat exchanger containing an organic fluid that is vaporized by a stream of substantially solvent-free product, an organic vapor turbine for expanding vaporized organic fluid produced by said heat exchanger and producing power and expanded vaporized organic fluid, and means for condensing said expanded vaporized organic fluid and producing condensate that is returned to said heat exchanger.

13. A solvent deasphalting unit according to claim 10 wherein said solvent vapor turbine has a plurality of stages, and said section includes a plurality of secondary flash drums respectively responsive to respective streams of reduced solvent liquid product for producing streams of reduced pressure vaporized solvent, and respective streams of still further reduced solvent liquid product, and means for applying said reduced pressure vaporized solvent to an intermediate stage of said turbine.

14. A solvent deasphalting unit according to claim 10 wherein said means to cool said final stream includes a heat exchanger for transferring heat from said final stream to said condensed solvent before the condensed solvent is returned to said solvent drum.

15. A solvent deasphalting unit according to claim 11 wherein said means for cooling said streams of substantially solvent-free product include respective further heat exchangers each of which contains organic fluid which is vaporized, and means for applying organic fluid vaporized by said further heat exchangers to said organic vapor turbine.

16. Apparatus for producing power comprising:

a) a flash drum for receiving a liquid stream of solvent-containing product from a solvent deasphalting unit and producing a high pressure, vaporized solvent stream, and a reduced solvent liquid product stream;

b) cooling apparatus to which said vaporized solvent stream is applied for cooling and condensing the latter at a lower pressure; and c) a solvent vapor turbine for expanding said vaporized solvent stream before it is applied to said cooling apparatus.

17. Apparatus according to claim 16 including a stripper for receiving said reduced solvent liquid product stream and producing a stripped vaporized solvent stream, and a substantially solvent-free product stream, and means for using heat contained in said substantially solvent-free product stream to generate power.

18. Apparatus according to claim 17 wherein said means for using heat includes a heat exchanger containing an organic fluid for receiving said substantially solvent-free product stream and producing a cooled substantially solvent-free product stream and vaporized organic fluid, an organic vapor turbine for expanding said vaporized organic fluid and producing power and expanded vaporized organic fluid, a condenser for condensing said expanded vaporized organic fluid and producing condensate, and means for returning said condensate to said heat exchanger.

19. Apparatus according to claim 17 including means for using heat contained in said stripped vaporized solvent stream for generating power.

20. Apparatus for producing power in a solvent recovery section of a solvent deasphalting unit to which two feed streams are supplied from a separator in which a liquid solvent is mixed with residual oil, said apparatus comprising:

a) a flash drum having an overhead and a bottom for receiving one of said feed streams and producing a first solvent vapor stream from said overhead, and a reduced solvent liquid product stream from said bottom;

b) a product stripper for receiving said reduced solvent liquid product stream and producing a second vapor stream at a pressure lower than the pressure of said first vapor stream, and for producing a substantially solvent-free product stream;

c) a solvent vapor turbine for expanding said first solvent vapor stream for producing power and an expanded solvent vapor stream;

d) means for combining said expanded solvent vapor stream with said second vapor stream to produce a combined vapor stream;

e) a first heat exchanger for extracting heat from said combined vapor stream by exchanging heat with an organic fluid for cooling said combined vapor stream and vaporizing said organic fluid;

f) an organic vapor turbine for expanding said vaporized organic fluid for producing power and from which expanded organic vapor is extracted;

g) means for cooling and condensing said expanded organic vapor to produce organic fluid condensate and for returning a portion of said condensate to said first heat exchanger;

h) a second heat exchanger for extracting heat from said substantially solvent-free product stream by exchanging heat with a further portion of said condensate for cooling said last mentioned product and vaporizing said further portion of said condensate to produce further vaporized condensate;

i) means for supplying said further vaporized condensate to said organic vapor turbine;

j) means for converting the other of said feed streams to a second substantially solvent-free product stream;

k) a third heat exchanger for extracting heat from second substantially solvent-free product stream by exchanging heat with a still further portion of said condensate for cooling said last mentioned product stream and vaporizing said still further portion of said condensate to produce still further vaporized condensate; and l) means for supplying said still further portion of vaporized condensate to said organic vapor turbine.

21. A solvent deasphalting unit for processing a hydrocarbon feed comprising:

a) a storage drum containing liquid solvent;

b) a separator that receives said feed and a stream of solvent from said storage drum for producing a first liquid stream containing solvent and deasphalted oil, and a second liquid stream containing solvent and asphaltenes;

c) a first flash drum for receiving said first liquid stream and producing an output stream of vaporized solvent, and an output stream containing deasphalted oil and a reduced amount of solvent;

d) an organic Rankine cycle turbine for expanding said vaporized solvent and producing power and expanded vaporized solvent;

e) a condenser for condensing said expanded vaporized solvent to a condensed liquid; and f) means for returning said condensed liquid to said storage drum.

22. A solvent deasphalting unit according to claim 21 including:

a) a first stripper responsive to said output stream containing deasphalted oil and a reduced amount of solvent for producing a stream of vaporized solvent and a product stream of substantially solvent-free deasphalted oil;

b) an organic Rankine cycle turbine for expanding said stream of vaporized solvent produced by said first stripper, and producing power and expanded vaporized solvent; and c) means for supplying said last mentioned expanded vaporized solvent to said condenser.

23. A solvent deasphalting unit according to claim 22 wherein the stream of vaporized solvent produced by said first stripper and the stream of vaporized solvent produced by said first flash drum are expanded in the same organic vapor turbine.

24. A solvent deasphalting unit according to claim 21 including:

a) a second flash drum for receiving said second liquid stream and producing an output stream of vaporized solvent, and an output stream containing asphaltenes and a reduced amount of solvent; and b) means for applying the stream of vaporized solvent produced by said second flash drum to said turbine.

25. A solvent deasphalting unit according to claim 24 including:

a) a first stripper responsive to said output stream containing deasphalted oil and a reduced amount of solvent for producing a stream of vaporized solvent and a product stream of substantially solvent-free deasphalted oil;

b) a second stripper responsive to said output stream containing asphaltenes and a reduced amount of solvent for producing a stream of vaporized solvent and a product stream of substantially solvent-free asphaltenes; and c) an organic Rankine cycle turbine for expanding said stream of vaporized solvent produced by said first and second strippers, and producing power and expanded vaporized solvent.

26. A solvent deasphalting unit according to claim 25 wherein the streams of vaporized solvent produced by said first and second strippers are expanded in the same organic vapor turbine in which the streams of vaporized solvent produced by the first and second flash drums are vaporized.

27. Apparatus for producing power in a solvent deasphalting unit to which two feed streams are supplied from a separator in which a liquid solvent is mixed with residual oil, said apparatus comprising:

a) a flash drum having an overhead and a bottom for receiving one of said feed streams and producing a first solvent vapor stream from said overhead, and concentrated liquid stream from said bottom;

b) a product stripper for receiving said concentrated liquid and producing a second solvent vapor stream at a pressure lower than the pressure of said first vapor stream, and for producing a product stream substantially free of solvent;

c) an organic vapor turbine for expanding said first solvent vapor stream for producing power and an expanded solvent vapor stream;

d) means for combining said expanded solvent vapor stream with said second solvent vapor stream to produce a combined solvent vapor stream;

e) a first heat exchanger for extracting heat from said combined solvent vapor stream by exchanging heat with an organic fluid for cooling said combined solvent stream and vaporizing said organic fluid;

f) a further organic vapor Rankine cycle turbine for expanding said vaporized organic fluid for producing power and from which expanded organic vapor is extracted;

g) means for cooling and condensing said expanded organic vapor to produce organic fluid condensate and for returning a portion of said condensate to said first heat exchanger;

h) a second heat exchanger for extracting heat from said product substantially free of solvent by exchanging heat with a further portion of said condensate for cooling said last mentioned product and vaporizing said further portion of said condensate;

i) means for supplying the further portion of said vaporized condensate to the inlet of said further organic Rankine cycle turbine;

j) means for converting the other of said feed streams to a second product stream substantially free of solvent;

k) a third heat exchanger for extracting heat from second product stream by exchanging heat with a still further portion of said condensate for cooling said last mentioned product and vaporizing said still further portion of said condensate to produce further vaporized condensate;

l) means for supplying said still further portion of vaporized condensate to an intermediate stage of said further organic vapor Rankine cycle turbine; and m) means for supplying vaporized organic fluid to a further intermediate stage of said further organic vapor Rankine cycle turbine.

* * * * *

UNITED STATES PATENT AND TRADEMARK OFFICE

CERTIFICATE OF CORRECTION

PATENT NO. : 5,804,060

DATED : September 8, 1998

INVENTOR(S) : Benguigui et al.

It is certified that error appears in the above-identified patent and that said Letters Patent is hereby corrected as shown below:

Column 6, line 37, change "2" to --2A--.

Signed and Sealed this

Twenty-third Day of February, 1999

*Attest:*

Q. TODD DICKINSON

*Attesting Officer*

*Acting Commissioner of Patents and Trademarks*